US010814615B2

(12) United States Patent
Bagnoli et al.

(10) Patent No.: US 10,814,615 B2
(45) Date of Patent: Oct. 27, 2020

(54) METHOD AND DEVICE FOR THE CONTROL AND THE MANAGEMENT OF THE PRINTING PARAMETERS OF A FLEXOGRAPHIC PRINTING MACHINE

(71) Applicant: BOBST FIRENZE S.R.L., Campi Bisenzio (FI) (IT)

(72) Inventors: Ugo Bagnoli, San Casciano in Val di Pesa (IT); Federico D'Annunzio, Florence (IT); Ludovico Frati, Siena (IT)

(73) Assignee: BOBST FIRENZE S.R.L., Campi Bisenzio (FI) (IT)

( * ) Notice: Subject to any disclaimer, the term of this patent is extended or adjusted under 35 U.S.C. 154(b) by 0 days.

(21) Appl. No.: 15/126,034

(22) PCT Filed: Mar. 19, 2015

(86) PCT No.: PCT/IB2015/052031

§ 371 (c)(1),
(2) Date: Sep. 14, 2016

(87) PCT Pub. No.: WO2015/140756

PCT Pub. Date: Sep. 24, 2015

(65) Prior Publication Data

US 2017/0072678 A1 Mar. 16, 2017

(30) Foreign Application Priority Data

Mar. 21, 2014 (IT) ..... MI2014A0475

(51) Int. Cl.
*B41F 23/04* (2006.01)
*B41F 5/24* (2006.01)
(Continued)

(52) U.S. Cl.
CPC ..... *B41F 23/04* (2013.01); *B41F 5/24* (2013.01); *B41F 13/22* (2013.01); *B41F 31/002* (2013.01);
(Continued)

(58) Field of Classification Search
CPC ..... B41F 23/04
(Continued)

(56) References Cited

U.S. PATENT DOCUMENTS 4,151,796 A * 5/1979 Uhrig ..... B41F 7/24 101/142
5,272,971 A * 12/1993 Fredericks ..... B41F 31/002 101/136
(Continued)

FOREIGN PATENT DOCUMENTS

DE 102004052822 A1 5/2006
DE 102005003836 A1 8/2006
(Continued)

OTHER PUBLICATIONS

International Search Report and Written Opinion for International Application No. PCT/IB2015/052031(dated Jul. 8, 2015) (10 pages).

*Primary Examiner* — Anthony H Nguyen
(74) *Attorney, Agent, or Firm* — Lucas & Mercanti, LLP

(57) ABSTRACT

The present invention relates to a device or method for detecting and adjusting the printing parameters in flexographic printing machines.

15 Claims, 1 Drawing Sheet

(51) Int. Cl.
*B41F 33/00* (2006.01)
*B41F 31/00* (2006.01)
*B41F 13/22* (2006.01)

(52) U.S. Cl.
CPC ..... *B41F 31/005* (2013.01); *B41F 33/0045* (2013.01)

(58) Field of Classification Search
USPC ..... 101/484
See application file for complete search history.

(56) References Cited

U.S. PATENT DOCUMENTS 7,017,493 B2 * 3/2006 Jung ..... B41F 23/08 101/487
2003/0196347 A1 * 10/2003 Kolbe ..... B41F 23/0483 34/273
2003/0217659 A1 * 11/2003 Yamamoto ..... B41F 33/0045 101/350.1
2005/0211121 A1 * 9/2005 Vest ..... G03F 7/24 101/401.1
2006/0062617 A1 * 3/2006 Yamasaki ..... G03G 15/5062 399/384
2006/0114302 A1 * 6/2006 Holtman ..... B41J 11/002 347/88
2008/0011171 A1 * 1/2008 Schneider ..... B41F 31/002 101/350.1
2008/0205223 A1 * 8/2008 Miyazaki ..... B41J 29/393 369/53.12
2008/0216695 A1 * 9/2008 Ozaki ..... B41F 31/045 101/484
2009/0301330 A1 * 12/2009 Noy ..... B41F 13/30 101/484
2010/0045720 A1 * 2/2010 Williams ..... B41J 11/002 347/14
2010/0079524 A1 * 4/2010 Saita ..... H04N 1/6033 347/14
2010/0208021 A1 * 8/2010 Hori ..... B41J 2/0057 347/102
2011/0088577 A1 4/2011 Berti et al.
2011/0132221 A1 * 6/2011 Hartmann ..... B41F 33/0036 101/484
2012/0098882 A1 * 4/2012 Onishi ..... B41J 2/0057 347/18
2012/0111215 A1 * 5/2012 Baptista ..... B41M 1/04 101/483
2013/0186290 A1 * 7/2013 Paul ..... B41F 31/045 101/348
2013/0305944 A1 * 11/2013 Moore ..... B41M 1/06 101/450.1
2016/0368261 A1 * 12/2016 Le Bris ..... B41M 7/0054

FOREIGN PATENT DOCUMENTS

EP 0509226 A1 10/1992
EP 2014464 A1 1/2009
EP 2384892 A1 11/2011

* cited by examiner

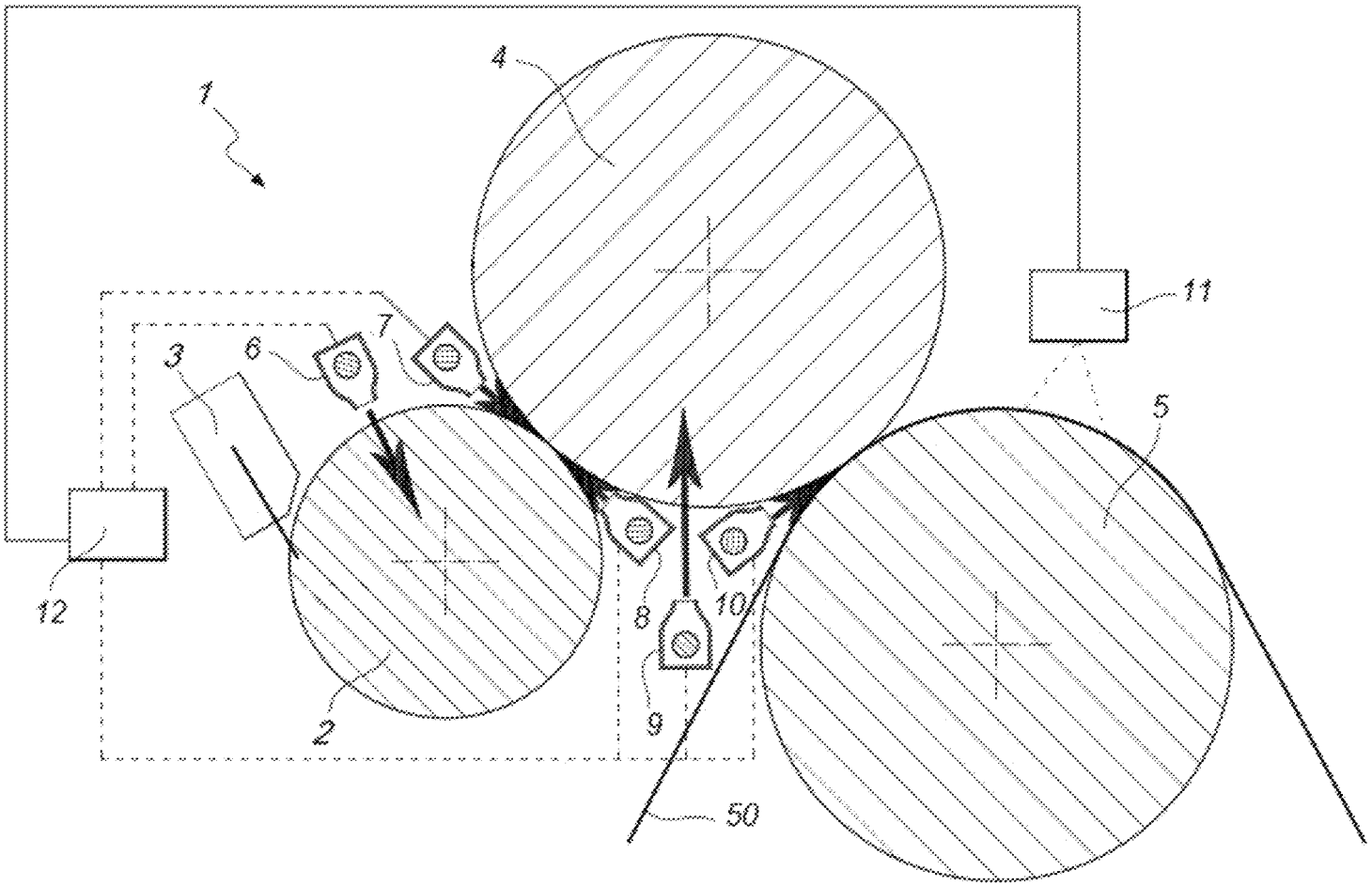
1
2
3
4
5
6
7
8
9
10
11
12
50

METHOD AND DEVICE FOR THE CONTROL AND THE MANAGEMENT OF THE PRINTING PARAMETERS OF A FLEXOGRAPHIC PRINTING MACHINE

CROSS-REFERENCE TO RELATED APPLICATIONS

This application is a 371 of PCT/IB2015/052031, filed Mar. 19, 2015, which claims the benefit of Italian Patent Application No. MI2014A000475 filed Mar. 21, 2014.

TECHNICAL FIELD OF THE INVENTION

The present invention relates to a device or method for detecting and adjusting the printing parameters in flexographic printing machines.

BACKGROUND OF THE INVENTION

As is known, flexographic printing machines comprise a plurality of rollers mutually tangent and counter-rotating for transferring an ink film to a print medium by for example a group comprising an ink container, an anilox roller and a doctor blade. A particularly pressing problem is that, with an increase in the printing speed (namely an increase in the speed of rotation of the printing rollers), the quality of transfer of the ink from one roller to the other varies and consequently the quality of the final print makes worse. In particular, with a variation in the transfer quality of the ink, the printing parameters determined on the basis, for example, of the print density and colorimetric parameters (Lab) vary in an uncontrolled and independent manner. The colorimetric parameters include the luminance (L) expressed as a percentage (O for black and 100 for white), while "a" and "b" refer to two colour ranges which vary respectively from green to red and from blue to yellow with values of between −120 and +120.

It has also been noted that, in order to compensate for this variation in the print quality, it is required to adjust the capacity for correctly transferring the ink independently of the printing speed. A currently known method for obtaining this result is to increase or reduce the relative distance between the printing rollers since, as a result of their movement away or towards each other, the pressure of transfer of the ink from one roller to another is varied and this variation in pressure influences the ink transfer capacity on the print medium.

Among the known devices which make use of this method the device described in EP2384892 is mentioned. This device comprises means for detecting the print values in the form of video cameras and irradiation means which irradiate a given portion of the printing roller to promote the resolution of video cameras. Depending on the values determined by these detection means the two rollers are moved away from each other. The ink transfer quality therefore remains constant by variation of the relative pressure of the two rollers.

However, this solution has drawbacks arising in particular from the constructional complication of having to provide a control system responsible for varying the relative distance of the rollers. Moreover, in particular in flexographic printing where the contact pressure between roller and medium greatly influences the print quality, adjusting the pressure in order to counteract the variation in the printing parameters may on the contrary adversely affect said print quality. In fact, with an excessive pressure, the printing cliché, since it is made of plastic material, may deform, resulting in print defects which are typical of an incorrect printing pressure.

SUMMARY OF THE INVENTION

The object of the present invention is to provide a device and a method for detecting and adjusting the printing parameters in flexographic printing machines (such as, in particular, the print density and the colorimetric parameters) which are able to solve the aforementioned problems and in particular reduce, if not eliminate entirely, the independent variation of the print density and the colorimetric parameters when there is an increase in the printing speed.

In particular an object of the present invention is to overcome these drawbacks of the known devices and provide a technical variant which is advantageous compared to the latter.

A further object of the present invention is to provide a device and a method for controlling the print density and the colorimetric parameters in flexographic printing machines, where the device may also be installed on ready-existing printing units.

Yet another object is to provide a device in which there exists the possibility of adjusting the printing parameters at very short time intervals, i.e. more or less in real time.

Finally, an object of the present invention is to provide a device and a method for controlling the print density and the colorimetric parameters in flexographic printing machines which are highly reliable, relatively simple to realize and have a competitive cost.

These results are achieved by the device and the associated method for detecting and adjusting the printing parameters in flexographic printing machines according to the present invention, the essential characteristic features of which are described, respectively, in claim 1 and claim 13. Further important characteristic features are also described in the dependent claims.

BRIEF DESCRIPTION OF THE DRAWINGS

The characteristic features and advantages of the device and the associated method according to the present invention will emerge apparently from the following detailed description of preferred embodiments thereof, provided by way of a non-limiting example, with reference to the accompanying FIGURE which shows, in schematic form, the device according to the invention applied to a flexographic printing unit.

DETAILED DESCRIPTION OF THE INVENTION

With reference to the aforementioned FIGURE, the device according to the invention is denoted overall by the reference number 1. This device is associated with a flexographic printing unit comprising, according to a configuration known in the sector, a set of mutually tangent and counter-rotating rollers which perform the transfer of an ink film onto a print medium. In particular, this printing unit comprises a first roller or anilox roller 2 associated with a doctor blade 3, from which the ink is transferred to a second roller or printing roller (or printing sleeve 4). A third roller, or counter-roller 5, on which at least one print medium is at least partially wound, is also associated with these two rollers. The reference number 50 indicates a print medium on which printing is performed and which is wound between the printing roller 4 and the counter-roller 5.

Examining more closely the present invention, the device comprises at least one infrared ray emission means which is in the form of a lamp emitting infrared rays, or IR lamp. The IR lamp, as will be clarified further below, irradiates the ink film, favouring its transfer to the print medium, with a consequent increase in the quality of the printing parameters.

This improved transfer is due at least partly to heating of the ink performed by the IR lamps which results in greater fluidification. Heating, as will be seen below, is in fact instantaneous since the thermal inertia is very low and this allows the printing parameters to be adjusted more or less in real time. The use of infrared radiation also involves a pre-polymerization of the ink, which facilitates adhesion and transfer to the print medium.

The IR lamps used are of the known type, for example with a tungsten or carbon filament.

In a preferred constructional solution the lamp is positioned so as to irradiate the ink film on the anilox roller 2. For this purpose it is arranged so as to irradiate the roller area situated immediately following the doctor blade. In the FIGURE the IR lamp which assumes this position is indicated by the reference number 6.

Alternatively, the infrared emission lamp may be positioned between the ink collection tray (not shown) and the doctor blade 3.

It is also possible to provide, alternatively or in addition, infrared lamps which allow the surface of the printing roller 4 to be irradiated. The lamps indicated in the FIGURE by 7 and 8 are in a position such as to strike simultaneously, along the line of tangency, the printing roller 4 and the anilox roller 2, when the latter has already collected the ink inside the tray and is transferring it to the printing roller 4. Possibly, only one lamp can be provided.

The lamp in the position 9 irradiates directly and specifically the ink film on the printing roller, while the lamp in the position 10 irradiates it along the line of tangency between the printing roller and the counter-roller.

Basically, to summarise, the infrared radiation emission means may be arranged in a position such as to irradiate the ink film on the anilox roller, on the printing roller or also on the counter-roller or in combinations of these positions, as shown in the FIGURE.

In particular, the infrared radiation emission means may be arranged so as to irradiate the ink film both on the surface of the anilox roller and on the surface of printing roller, after the printing roller comes into contact with the anilox roller, or so as to irradiate simultaneously the film both on the surface of the anilox roller and on the surface of the printing roller, soon after the printing roller has separated from the anilox roller.

Also possible is positioning of multiple emission means so as to obtain combinations of the irradiation positions described above.

The device according to the invention also comprises detection means which detect the printing parameters described above (such as, in particular, print density and colorimetric parameters) on the print medium 50. These detection means (shown only schematically in the FIGURE and indicated by the number 11) comprise print inspection systems known in the sector and therefore not described in detail. For example, these inspection systems comprise at least one spectral measurement module realized by means of display systems such as video cameras. In a less expensive solution the inspection systems provide video cameras equipped with software processing system for comparing the observed image with a reference image.

In the preferred constructional solution the inspection systems are positioned so as to be aimed at the print medium 50, and in general at the end of the printing line, to analyse the print after each repetition and monitor its colorimetric parameters with a view to determining the presence of defects.

This information regarding the values of the printing parameters is sent to control means 12 comprising a PID controller (proportional-integral-derivative controller) of the known type which carries out a closed-loop check. The PID controller, comparing the input data of the inspection systems with the preset target data (namely the ideal reference value of the printing parameters) determines the error, namely the difference between the values detected and the target values. If the error is different from zero (+ or − a given tolerance), the PID controller 12 activates the infrared emission means so that they irradiate the ink film. In even greater detail, the PID controller monitors continuously the printing process checking the aforementioned parameters and increasing or decreasing consequently (according a operation typical of the PID controllers) the intensity of the radiation. It is possible to manage the radiation intensity either by modifying the emission power or the frequency. Frequency control is advantageous because the inks used are sensitive to irradiation in given frequency ranges.

Furthermore, although in the preferred constructional solution, the PID manages the variation in power of the IR lamps continuously, it is quite possible for this variation in power to occur also in pulsed form (namely the percentage increase in power to be supplied is calculated as a sum of a series of on/off emissions of the lamp).

As mentioned above, the radius of action of these means on the ink film favours its transfer onto the print medium and this results in an improved quality of the final print. This result is obtained owing to a combination of factors including, for example, heating of the ink due to the infrared radiation. This heating results in a consequent fluidification of the ink and therefore facilitates transfer thereof from the rollers to the print medium. Moreover, the use in particular of infrared radiation, in addition to the aforementioned heating, also results in pre-polymerization of the ink, and therefore better adhesion to the print medium, facilitating adhesion thereof and transfer to the print medium and helping, consequently, increase the final quality of the print.

It has been established in practice how the device and the method according to the present invention allow the density and Lab colorimetric parameters of the flexographic machines to be controlled, using infrared radiation which may be directed at least either onto the surface of the anilox roller or at least onto the surface of the printing roller or also onto both of them, with continuous control and/or pulsed radiation independently of the operating conditions of the printing machine, and in particular independently of the printing speed and diameter of the rollers.

In addition to the advantages mentioned above, the use of IR lamps also offers a further series of advantages.

In particular, the transmission of energy to the ink film is in fact instantaneous (very low thermal inertia) and there is therefore the possibility of adjusting the printing parameters at very short time intervals, more or less continuously.

Furthermore, owing to its structural simplicity, the device according to the invention may be applied to pre-existing printing units and takes the form of an easily removable independent device. The installation of the device does not require structural modifications of the rollers or the printing machine as a whole, nor the introduction of complex roller cooling or temperature control systems.

The device can be installed on printing machines of the type described above but also on printing machines of inkjet type.

Finally, the device is extremely reliable since it is constructionally simple; this also results in an overall cost which is less than that of known systems such as those described above.

The present invention has been described hitherto with reference to preferred embodiments thereof. It is to be understood that each of the technical solutions implemented in the preferred embodiments described here by way of example may be advantageously combined in various ways with each other, so as to give rise to other embodiments which relate to the same inventive idea, but all falling within the scope of protection of the claims provided hereinbelow

The invention claimed is:

1. A device for detecting and adjusting the printing parameters in a flexographic printing machine, said flexographic printing machine comprising a set of mutually tangent and counter-rotating rollers for transferring an ink film to a print medium, said device comprising:

means for detecting on said print medium values of printing parameters;

control means for receiving said values detected by said means for detecting and comparing said values detected with predefined values of said printing parameters; and at least one infrared radiation emission means activated and managed by said control means when said values detected differ from said predefined values, said at least one infrared radiation emission means being configured to emit infrared radiation sufficient to induce fluidification of the ink film on at least one of said rollers of said printing machine thereby improving transmission of said ink film from at least one of said rollers onto said print medium.

2. The device according to claim 1, wherein said at least one infrared radiation emission means comprise at least one infrared lamp.

3. The device according to claim 1, wherein said control means comprise a proportional-integral-derivative (PID) controller.

4. The device according to claim 3, wherein said PID controller manages said at least one infrared radiation emission means so as to modify the intensity of the infrared radiation emitted.

5. The device according to claim 4, wherein said PID controller varies the power of the infrared radiation.

6. The device according to claim 4, wherein said PID controller varies the emission frequency of the infrared radiation.

7. The device according to claim 1, wherein said means for detecting comprises at least one spectral measurement module.

8. The device according to claim 1, adapted to be mounted on a flexographic printing machine comprising at least three rollers, said at least three rollers comprising a first roller which gets the ink, a doctor blade associated with said first roller, a second roller for transferring the ink to a print medium, and a third roller around which said print medium is at least partially wound, said at least one infrared radiation emission means being located so as to irradiate said ink film on the surface of said first roller at a position intermediate said doctor blade and where said first roller and said second roller contact each other.

9. The device according to claim 8, wherein said at least one infrared radiation emission means is configured to irradiate the ink film on the surface of said second roller.

10. The device according to claim 8, wherein said at least one infrared radiation emission means is configured to irradiate simultaneously the surface of said first and said second rollers.

11. The device according to claim 8, wherein said at least one infrared radiation emission means is configured to irradiate simultaneously said second roller and said third roller.

12. The device according to claim 8, wherein said means for detecting is located in correspondence of said print medium at the end of the printing line.

13. Method for detecting and adjusting the print density and the colorimetric parameters in a flexographic printing machine, the flexographic printing machine comprising a set of mutually tangent and counter-rotating rollers for transferring an ink film to a print medium, said method comprising the following steps:

detecting on said print medium values of printing parameters;

comparing said detected values with predefined values of printing parameters;

in the case where said detected values differ from said predefined values, activating at least one infrared radiation emission means so as to emit infrared radiation sufficient to induce fluidification of the ink film on at least one of said rollers thereby improving transmission of said ink film from at least one of said rollers to said print medium;

varying the intensity of said emission of infrared radiation so as to modify said detected values; and repeating the steps listed above until said detected values correspond to said predefined values.

14. The method according to claim 13, wherein said variation in the intensity of said infrared radiation is obtained by adjusting the power of said emission.

15. The method according to claim 14, wherein said variation in the intensity of said infrared radiation is obtained by varying the frequency of said emission.

* * * * *